US009121629B2

(12) United States Patent
Sugimura et al.

(10) Patent No.: US 9,121,629 B2
(45) Date of Patent: Sep. 1, 2015

(54) CONDENSER

(75) Inventors: Ryohei Sugimura, Inazawa (JP); Hiroki Matsuo, Kariya (JP); Ken Mutou, Obu (JP); Masahiro Omae, Kariya (JP); Masanobu Iio, Chiryu (JP)

(73) Assignee: DENSO CORPORATION, Kariya (JP)

( * ) Notice: Subject to any disclaimer, the term of this patent is extended or adjusted under 35 U.S.C. 154(b) by 375 days.

(21) Appl. No.: 13/136,289

(22) Filed: Jul. 28, 2011

(65) Prior Publication Data

US 2012/0031586 A1 Feb. 9, 2012

(30) Foreign Application Priority Data

Aug. 3, 2010 (JP) ..... 2010-174777
Apr. 1, 2011 (JP) ..... 2011-082155

(51) Int. Cl.

| | |
|---|---|
| ***F25B 39/04*** | (2006.01) |
| ***F28F 1/40*** | (2006.01) |
| *F28D 1/053* | (2006.01) |
| *F28D 21/00* | (2006.01) |

(52) U.S. Cl.

CPC . *F25B 39/04* (2013.01); *F28F 1/40* (2013.01); *F25B 2500/01* (2013.01); *F28D 1/053* (2013.01); *F28D 1/05316* (2013.01); *F28D 2021/0084* (2013.01); *F28F 2275/04* (2013.01); *F28F 2275/045* (2013.01)

(58) Field of Classification Search

CPC ..... F28F 1/40; F28F 1/405; F28F 13/02; F28F 13/08; F28F 2275/04; F28D 1/053; F28D 1/5316; F28D 1/0535

USPC ..... 165/152, 153, 179, 182, 183, 177, 181; 228/183

See application file for complete search history.

(56) References Cited

U.S. PATENT DOCUMENTS 4,998,580 A * 3/1991 Guntly et al. ..... 165/133
5,271,458 A * 12/1993 Yamamoto et al. ..... 165/152
5,682,944 A 11/1997 Yamamoto et al.

(Continued)

FOREIGN PATENT DOCUMENTS

JP S62-005098 1/1987
JP 2001-165532 6/2001

(Continued)

OTHER PUBLICATIONS

Office Action issued Nov. 26, 2013 in corresponding JP Application No. 2011-082155 (with English translation).

(Continued)

*Primary Examiner* — Judy Swann
*Assistant Examiner* — John Higgins
(74) *Attorney, Agent, or Firm* — Harness, Dickey & Pierce, PLC

(57) ABSTRACT

Each tube and a corresponding fin satisfy all of the following relationships: $Lp-t \geq 0.03Tr+0.22$; $Lp-t \leq 0.115Tr^2-1.14Tr+2.35$; and $Lp-t \geq 5Tr^2-8.3Tr+3$, where Lp denotes a width of a sub-passages, Tr denotes a refrigerant passage height, and t denotes a plate thickness of the fin. The amount of a brazing material, which is present through an entire extent of the width of the sub-passage, is set to satisfy a relationship of $0.005 \leq S/L < 0.5$, where S denotes a size of a cross-sectional area of the brazing material, and L denotes a length of a center line of a corresponding portion of the fin, which is present through the entire extent of the width of the sub-passage.

8 Claims, 6 Drawing Sheets

(56) References Cited

U.S. PATENT DOCUMENTS

| | | | | |
|---|---|---|---|---|
| 2001/0004935 | A1 | 6/2001 | Sanada et al. | |
| 2007/0095514 | A1* | 5/2007 | Inoue et al. | 165/177 |
| 2007/0119581 | A1* | 5/2007 | Kato | 165/177 |
| 2009/0008061 | A1* | 1/2009 | Inagaki et al. | 165/80.4 |

FOREIGN PATENT DOCUMENTS

| | | |
|---|---|---|
| JP | 2005-090839 | 4/2005 |
| JP | 2007-125590 | 5/2007 |
| JP | 2008-008585 | 1/2008 |

OTHER PUBLICATIONS

Office Action issued Jun. 10, 2014 in corresponding JP Application No. 2011-082155 (with English translation).

* cited by examiner

AMOUNT OF BRAZING MATERIAL PER UNIT LENGTH $$\alpha = \frac{S}{L} \text{ (mm)}$$

$$(0.005 \leq \alpha < 0.5)$$

CONDENSER

CROSS REFERENCE TO RELATED APPLICATION

This application is based on and incorporates herein by reference Japanese Patent Application No. 2010-174777 filed on Aug. 3, 2010 and Japanese Patent Application No. 2011-82155 filed on Apr. 1, 2011.

BACKGROUND OF THE INVENTION

1. Field of the Invention

The present invention relates to a condenser.

2. Description of Related Art

Various techniques of improving a performance of a condenser have been known. For instance, JP2001-165532A (corresponding to US2001/0004935A1) teaches a technique (hereinafter also referred to as a first prior art technique) of improving a heat radiation performance of a condenser. According to this technique, a height of an inside space of a tube of the condenser, through which refrigerant flows, is set within a predetermined range, so that there is reduced a sum of the amount of reduction in the heat radiation performance, which is caused by an air flow resistance at an outside of the tube, and the amount of reduction in the heat radiation performance, which is caused by a pressure loss in the inside space of the tube. In this way, the heat radiation performance of the condenser is improved.

Furthermore, in a case of a conventional condenser, an inner fin is placed in an inside space of a tube of the condenser to divide the inside space of the tube into a plurality of passages. With respect to such a condenser, there is known another technique (hereinafter also referred to as a second prior art technique) of improving the heat radiation performance. Specifically, according to this known technique, the inner fin is arranged in the inside space of the tube such that a center-to-center pitch between each adjacent two passages defined in the tube is reduced to increase a total wet edge length in the inside of the tube to improve the heat radiation performance. Furthermore, it should be obvious that the heat radiation performance of the condenser can be improved by reducing the height of the inside space of the tube, which is measured in a stacking direction of the tubes, and thereby increasing the total number of the tubes of the condenser.

However, in the case of the second prior art technique and the case where the height of the inside space of the tube, which is measured in the stacking direction of the tubes, is reduced, a cross-sectional area of the passage in the inside of the tube is reduced. When the cross-sectional area of the passage in the inside of the tube becomes small, a brazing material, which is used to join between an inner wall of the tube and the inner fin, may possibly be throughly distributed in the inside of the tube to possibly cause clogging of the passage with the brazing material.

SUMMARY OF THE INVENTION

The present invention addresses the above disadvantages. According to the present invention, there is provided a condenser, which includes a condensing section.

The condensing section includes a plurality of tubes, which are stacked one after another in a stacking direction, and a plurality of fins, each of which is placed in an inside of a corresponding one of the plurality of tubes to divide a refrigerant passage of the tube into a plurality of sub-passages that are arranged one after another in a row in a row direction.

Each of the plurality of tubes forms a refrigerant passage therein to conduct refrigerant and is adapted to exchange heat between the refrigerant, which is in gas phase and is conducted through the refrigerant passage, and external fluid, which flows outside of the tube, to cause condensation of the refrigerant in the gas phase into the refrigerant in liquid phase in the tube at the condensing section. At least one of an inner wall surface of each of the plurality of tubes and a surface of each corresponding one of the plurality of fins placed in the tube is covered with a brazing material. Each of the plurality of tubes and each corresponding one of the plurality of fins satisfy all of the following relationships:

$$Lp-t \geq 0.03Tr+0.22;$$

$$Lp-t \leq 0.115Tr2-1.14Tr+2.35; \text{ and}$$

$$Lp-t \geq 5Tr2-8.3Tr+3, \text{ where:}$$

Lp denotes a width of one of the plurality of sub-passages of the tube; Tr denotes a refrigerant passage height, which is a height of the refrigerant passage of the tube measured in the stacking direction of the plurality of tubes; and t denotes a plate thickness of the fin in the tube. The brazing material, which covers the at least one of the inner wall surface of each of the plurality of tubes and the surface of each corresponding one of the plurality of fins placed in the tube, satisfies a relationship of $0.005 \leq S/L < 0.5$, where: S denotes a size of a cross-sectional area of the brazing material, which is present through an entire extent of the width of the one of the plurality of sub-passages in a plane that is parallel to the row direction of the plurality of sub-passages; L denotes a length of a center line of a corresponding portion of the fin, which is present through the entire extent of the width of the one of the plurality of sub-passages in the plane that is parallel to the row direction of the plurality of sub-passages; and S/L denotes an amount of the brazing material per unit length of the center line of the corresponding portion of the fin, which is present through the entire extent of the width of the one of the plurality of the sub-passages in the plane that is parallel to the row direction of the plurality of sub-passages.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION (First Embodiment)

A condenser according to a first embodiment of the present invention will be described with reference to FIGS. 1 to 10.

Figure 1:
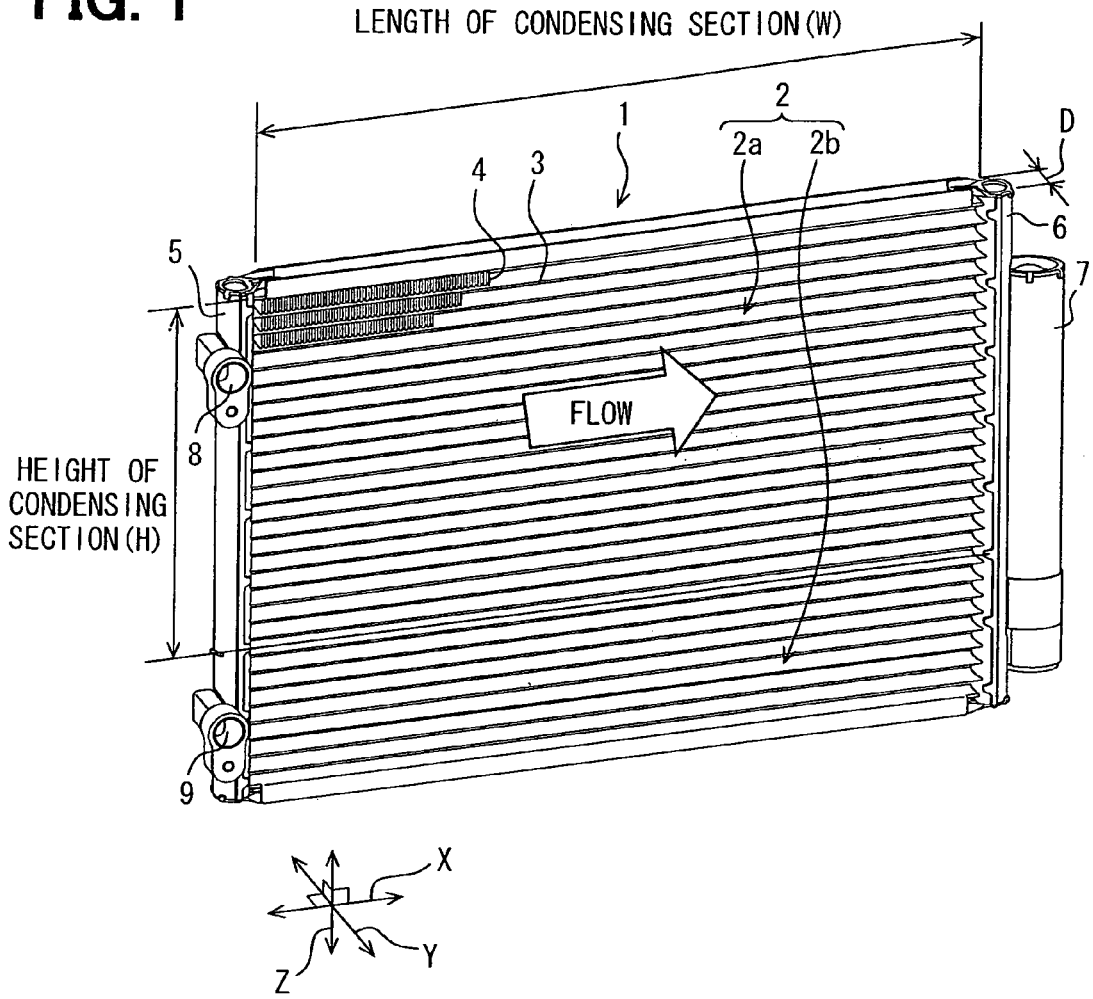
FIG. 1 is a perspective view of a condenser according to a first embodiment of the present invention.

With reference to FIG. 1, the condenser 1 of the present embodiment is a refrigerant condenser, which is provided with a liquid receiver integrated thereto and is used in a refrigeration cycle of an air conditioning system of a vehicle (e.g., an automobile). The condenser 1 includes a condensing section 2*a*, the liquid receiver 7 and a supercooling section 2*b*, which are integrated together. The condensing section 2*a* cools refrigerant, which is discharged from a compressor (not shown) of the refrigeration cycle, so that gas phase refrigerant is condensed into liquid phase refrigerant in the condensing section 2*a*. The liquid receiver 7 separates the refrigerant, which is discharged from the condensing section 2*a*, into the gas phase refrigerant and the liquid phase refrigerant. Furthermore, the liquid receiver 7 stores excessive refrigerant of the refrigeration cycle as the liquid phase refrigerant and outputs the liquid phase refrigerant to the supercooling section 2*b*. The supercooling section 2*b* cools the liquid phase refrigerant, which is outputted from the liquid receiver 7, so that a degree of supercooling is increased.

The condenser 1 has two header tanks, i.e., a first header tank 5 and a second header tank 6, each of which is configured into a generally cylindrical body. The first header tank 5 and the second header tank 6 are spaced from each other by a predetermined distance. A core 2, which is provided to exchange heat, is arranged between the first header tank 5 and the second header tank 6. The core 2 has the condensing section 2*a* and the supercooling section 2*b*. The condenser 1 is so-called a multi-flow type. Specifically, the refrigerant, which enters the first header tank 5, flows into the second header tank 6 through a plurality of refrigerant passages formed by a plurality of tubes 3 of the core 2, which are stacked one after another in a stacking direction. Each tube 3 has a generally flat cross section and conducts the refrigerant in a horizontal direction between the first header tank 5 and the second header tank 6. A corrugated outer fin 4 is held between each adjacent two of the tubes 3. The tubes 3 and the outer fins 4 held between the first header tank 5 and the second header tank 6 are joined together by brazing. One end part and the other end part of each tube 3, which are opposed to each other in a longitudinal direction of the tube 3, are communicated with an inside of the first header tank 5 and an inside of the second header tank 6, respectively.

An inlet-side pipe joint 8, through which the refrigerant is inputted, is arranged in an upper end part of the first header tank 5, and an outlet-side pipe joint 9, through which the refrigerant is outputted, is arranged in a lower end part of the first header tank 5. Both the inlet-side pipe joint 8 and the outlet-side pipe joint 9 are joined to the first header tank 5. A separator (not shown) is placed in the inside space of the first header tank 5 to partition the inside space of the first header tank 5 into upper and lower inside spaces. Similarly, a separator (not shown) is placed in the inside space of the second header tank 6 to partition the inside space of the second header tank 6 into upper and lower inside spaces. Therefore, the inside space of each of the first header tank 5 and the second header tank 6 is partitioned into the upper and lower inside spaces. Thus, the refrigerant, which enters through the inlet-side pipe joint 8, flows through the first header tank 5, the condensing section 2*a* and the second header tank 6 in this order. Thereby, a refrigerant flow, which is known as a full-path flow, is generated in the condensing section 2*a* (see a blank arrow shown in FIG. 1).

The liquid receiver 7, which is configured into a cylindrical body and stores the liquid phase refrigerant after separating the refrigerant into the gas phase refrigerant and the liquid phase refrigerant, is installed integrally to an outer side of the second header tank 6 such that the inside space of the second header tank 6 and the inside space of the liquid receiver 7 are communicated with each other. Specifically, the upper inside space, which is located above the separator in the second header tank 6, communicates with the inside space of the liquid receiver 7. Further, the inside space of the liquid receiver 7 communicates with the lower inside space, which is located below the separator in the second header tank 6. In addition, the components of the condensing section 2*a*, the supercooling section 2*b* and the liquid receiver 7 are made of aluminum or an aluminum alloy and are assembled together by brazing (e.g., a process of furnace brazing).

Preferably, dimensions of the condensing section 2*a* of the condenser 1 are set as follows. Specifically, the condensing section 2*a* satisfies the following equation 1.

$$7.0\times10^4 \leq W\cdot H \leq 4.2\times10^5 \quad \text{(Equation 1)}$$

In the above equation 1, W denotes a length of the condensing section 2*a*, which is measured in the longitudinal direction of the tube 3, and H denotes a height of the condensing section 2*a*, which is measured in the stacking direction (also referred to as a tube stacking direction) Z of the tubes 3. Furthermore, a condensing section thickness D of the condensing section 2*a*, which is a thickness of the condensing section 2*a* measured in a width direction Y (a flow direction of external fluid, such as air) of a sub-passage 321-324 described below, is set in a range of 5 mm to 30 mm. That is, the condensing section depth D also corresponds to a transverse length of the cross-section of the tube 3 that is measured in a direction perpendicular to the longitudinal direction of the tube 3 (see FIG. 2).

The refrigerant, which is discharged from the compressor of the refrigeration cycle, flows from the inlet-side pipe joint 8 to the upper inside space of the first header tank 5. Thereafter, the refrigerant flows from the upper inside space of the first header tank 5 to the upper inside space of the second header tank 6 through the tubes 3. Then, the refrigerant flows from the upper inside space of the second header tank 6 into the inside space of the liquid receiver 7 through a first communication passage, which communicates between the second header tank 6 and the liquid receiver 7. Further, the refrigerant flows from the liquid receiver 7 to the lower inside space of the second header tank 6 through a second communication passage, which is located below the first communication passage. Thereafter, the refrigerant flows from the lower inside space of the second header tank 6 to the outside of the condenser 1 through the supercooling section 2*b*, the lower inside space of the first header tank 5 and the outlet-side pipe joint 9 in this order.

Figure 2:
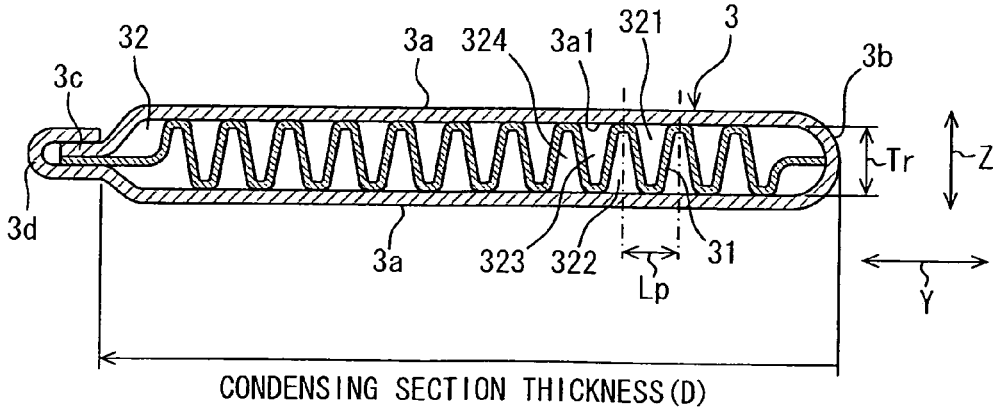
FIG. 2 is a cross-sectional view showing a structure in an inside of a tube according to the first embodiment.

FIG. 2 is a cross-sectional view showing a structure in the inside of the tube 3. As shown in FIG. 2, each tube 3 is formed as the flat tube and includes two planar portions 3*a*, a bent portion 3*b* and two connecting portions 3*c*, 3*d*. The planar portions 3*a* are opposed to each other in the stacking direction Z of the tubes 3 and are spaced from each other by a predetermined distance. The bent portion 3*b* is provided at one width ends of the planar portions 3*a* to join therebetween. The connecting portions 3*c*, 3*d* are formed in the other width ends, respectively, of the planar portions 3*a*. The connecting portions 3*c*, 3*d* are joined together in a state where the connecting portions 3*c*, 3*d* contact with each other. With reference to FIG. 2, the connecting portion 3*d*, which is returned by 180 degrees, is joined to the connecting portion 3*c* such that the connecting portion 3*d* covers the connecting portion 3*c* and an end part of an inner fin 31.

The inner fin 31 is a corrugated member that has ridges and valleys, which are alternately arranged one after another in the width direction Y. A refrigerant passage 32, which is defined in each corresponding tube 3 and conducts the refrigerant, has a generally flat cross section. Further, the refrigerant passage 32 is a passage defined by the planar portions 3*a*, the bent portion 3*b* and the connecting portions 3*c*, 3*d*. The planar portions 3*a* are elongated portions, which are opposed to each other and extend in the longitudinal direction of the tube 3. The bent portion 3*b* is one of two transverse portions, which are opposed to each other and extend in a direction generally perpendicular to the longitudinal direction of the tube 3, i.e., extend in the stacking direction Z of the tubes 3. The connecting portions 3*c*, 3*d* cooperate together to form the other one of the transverse portions. The inner fin 31 is arranged in the tube 3, so that the refrigerant passage 32 is divided into a plurality of sub-passages 321-324. The sub-passages 321-324 are arranged one after another in the longitudinal direction of the cross section of the refrigerant passage 32, i.e., in the width direction Y. The ridges and the valleys are joined to the inner wall surfaces 3*a*1 of the planar portions 3*a* by brazing, so that the sub-passages 321-324, which extend in the longitudinal direction X of the tube 3, are formed. When the tubes 3 are connected to the first header tank 5 and the second header tank 6 in such a manner that one end part and the other end part of each tube 3 are placed in the inside of the first header tank 5 and the inside of the second header tank 6, respectively, the sub-passages 321-324, which are formed by dividing the refrigerant passage 32, communicate with the inside of the first header tank 5 and the inside of the second header tank 6.

At least one of a surface of the inner fin 31 and the inner wall surface 3*a*1 of each of the planar portions 3*a* (the inner wall surface of the tube 3) is covered with the brazing material. The brazing material is made of, for example, an aluminum alloy. Here, the material of the tube 30 and/or of the inner fin 31, which is covered with the brazing material, may be referred to as a clad material, which is clad with the brazing material in advance. Alternatively, the material of the tube 30 and/or of the inner fin 31, which is covered with the brazing material, may be referred to as a coated material, which is coated with the brazing material in a form of paste later.

At the time of joining the inner fin 31 to the inner wall surfaces 3*a*1 of the planar portions 3*a* by the brazing, the inner fin 31 is placed in a manner shown in FIG. 2. Specifically, the inner fin 31 is joined to the inner wall surfaces 3*a*1 of the planar portions 3*a* by the brazing while the width direction Y of each sub-passage 321-324 generally coincides with the horizontal direction. Therefore, in the cross-sectional view of the inner fin 31 shown in FIG. 2, a left end one of the ridges of the inner fin 31 is first placed at a location adjacent to the left width end (the connecting portion 3*d* side) of the tube 3. Then, a left end one of the valleys of the inner fin 31 is placed next to the left end one of the ridges of the inner fin 31 on the right side thereof, and thereafter the remaining ridges and the valleys are alternately arranged one after another in the width direction Y. In this way, a space is defined between the left end ridge of the inner fin 31 and the lower planar portion 3*a* at a location adjacent to the left width end of the tube 3. Therefore, at the time of joining the inner fin 31 to the inner wall surfaces 3*a*1 of the planar portions 3*a* by the brazing, the molten brazing material can more easily flow toward the lower planar portion 3*a* side than to the upper planar portion 3*a* side. Thereby, at the time of joining the inner fin 31 to the inner wall surfaces 3*a*1 of the planar portions 3*a* by the brazing, the molten brazing material, which flows toward the lower planar portion 3*a*, is less likely to cause the clogging of the sub-passage in the inside of the tube 3 at the location adjacent to the left width end of the tube 3.

Figure 3:
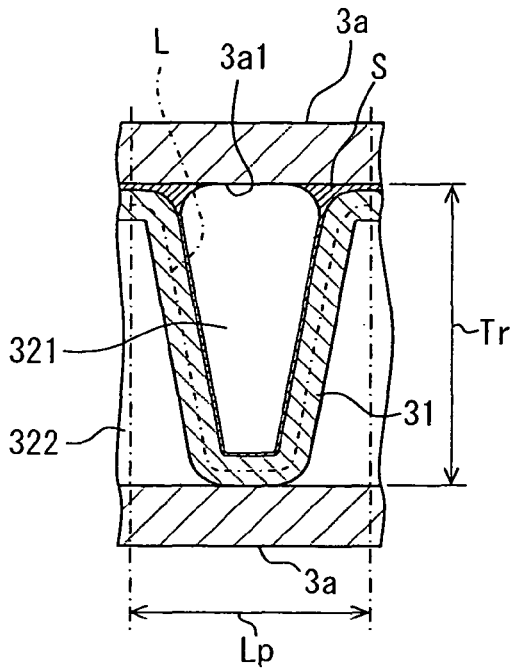
FIG. 3 is a partial enlarged cross-sectional view showing the inside of the tube of the first embodiment in a state where the amount of brazing material, which joins between an inner fin and an inner wall surface of the tube, is small.
Figure 3:
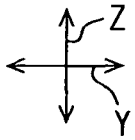

With reference to FIGS. 2 and 3, Lp denotes an inner fin pitch, i.e., a width of one of the sub-passages 321-324 defined by the inner fin 31. The inner fin pitch may be a center-to-center pitch of the ridges (i.e., a pitch measured from a center of one of the ridges to a center of the next one of the ridges). Alternatively, the inner fin pitch may be a center-to-center pitch of the valleys (i.e., a pitch measured from a center of one of the valleys to a center of the next one of the valleys). Tr denotes a refrigerant passage height, which is a height of the refrigerant passage 32 and is measured in the stacking direction Z of the tubes 3, and t denotes a plate thickness (wall thickness) of the inner fin 31. Further, S denotes a size of a cross-sectional area of the brazing material, which is present through an entire extent of the width Lp of the one of the sub-passages 321-324 in a plane that is parallel to the row direction of the sub-passages 321-324 in the tube 3, i.e., that extends in the width direction Y of the sub-passage 321-324 and also in the tube stacking direction Z. Furthermore, the inner fin 31 may include a plurality of communication holes (not shown), each of which is formed as a slit in a corresponding planar portion of the inner fin 31, which is located between the corresponding ridge and its adjacent valley. The refrigerant, which flows through each of the sub-passages 321-324, can go back and forth between the adjacent sub-passages 321-324 through the corresponding communication holes.

Next, with reference to FIGS. 3 to 5, a relationship between the sub-passage 321 and the amount of the brazing material as well as a definition of the clogging with the brazing material will be described for the case where the inner fin 31 is covered with the brazing material in advance. FIG. 3 is a cross-sectional view showing a state where the amount of the brazing material, which brazes the inner fin 31 and the inner wall surface 3*a*1 of the upper planar portion 3*a* together in the inside of the tube 3, is small. As shown in FIG. 3, in the case where the amount of the brazing material is small, the sub-passage 321, which is defined by the inner fin 31 and the inner wall surface 3*a*1 of the upper planar portion 3*a*, has a sufficient cross-sectional area. Therefore, in the sub-passage 321 of FIG. 3, the amount of each fillet is not large, and there is no disadvantageous clogging of the sub-passage 321 with the brazing material.

Preferably, in the sub-passage 321-324 of the tube 3, the amount of the brazing material is set within a predetermined range discussed later to limit the clogging of the sub-passage 321-324. With reference to FIGS. 2 and 3, in the cross section of the tube 3, which is taken in a direction of a row (also referred to as a row direction) of the sub-passages 321-324, i.e., in the width direction Y, a size of a cross-sectional area of the brazing material, which is present along the inner fin 31 through the extent of the width Lp (mm) of one (e.g., the sub-passage 321 in FIGS. 2 and 3) of the sub-passages 321-324, is denoted by S ($mm^2$), and a length of a center line of a corresponding portion of the inner fin 31, which is present through the entire extent of the width Lp (mm) of the one of the plurality of sub-passages 321-324 in the plane that is parallel to the row direction of the sub-passages 321-324, is denoted by L. In other words, the length L of the center line of the corresponding portion of the inner fin 31 within the extent of the width Lp (mm) is measured from the left dot-dash line to the right dot-dash line along the center line of the inner fin 31 in FIG. 3. Here, the amount $\alpha$($\alpha$=S/L (mm)) of the brazing material per unit length of the center line (i.e., a unit length along the length L of the center line) of the corresponding portion of the inner fin 31, which is present through the entire extent of the width Lp (mm) of the one of the sub-passages 321-324 in the plane that is parallel to the row direction of the sub-passages 321-324, is set to satisfy a relationship of $0.005 \leq \alpha(=S/L) < 0.5$.

The cross section, which is parallel to the row direction of the sub-passages 321-324, is a plane, which extends in the pitch direction (the width direction Y of the sub-passage) of the inner fin 31 and in the tube stacking direction Z. That is, the cross section, which is parallel to the row direction of the sub-passages 321-324, is the plane, which does not cross the direction Y and the direction Z. Therefore, as shown in FIG. 3, the size of the cross-sectional area of the brazing material, which is present along the inner fin 31 through the extent of the width Lp (mm) of the one (the sub-passage 321 in FIGS. 2 and 3) of the sub-passages 321-324 in this plane (i.e., the cross section of the tube 3 and the inner fin 31 shown in FIG. 3), is denoted by S ($mm^2$), and the length of the center line of the corresponding portion of the inner fin 31, which is present through the extent of the width Lp (mm) of the one of the plurality of sub-passages 321-324 in this plane, is denoted by L.

Figure 4:
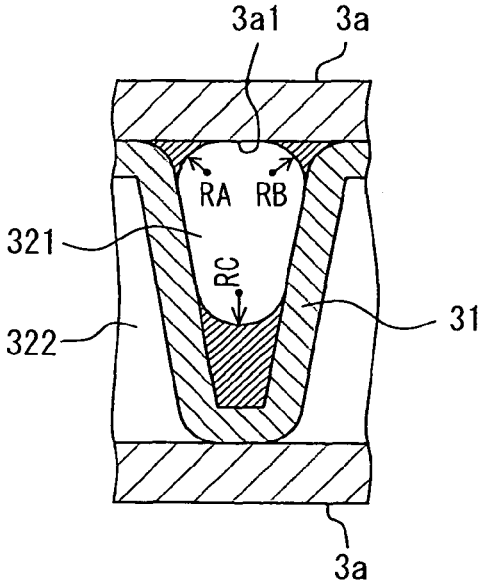
FIG. 4 is a partial enlarged cross-sectional view showing the inside of the tube of the first embodiment in a state where the amount of brazing material is increased in comparison to that of FIG. 3.

Next, FIG. 4 shows a state where the amount of the applied brazing material is larger than that of FIG. 3. When the amount of the applied brazing material is increased like in the case of FIG. 4, the size of each fillet is increased. Therefore, due to an influence of a surface tension of the brazing material, the cross-sectional shape of each fillet becomes a shape of a quadrant (one quarter of a circule) having a corresponding radius RA, RB, RC of curvature. In FIG. 4, the fillet, which has the radius RA of curvature, is formed by the brazing material, which joins between the inner wall surface 3*a*1 of the planar portion 3*a* and the corresponding ridge (the left ridge in FIG. 4) of the inner fin 31, and the fillet, which has the radius RB of curvature, is formed by the brazing material, which joins between the inner wall surface 3*a*1 of the planar portion 3*a* and the corresponding ridge (the right ridge in FIG. 4) of the inner fin 31. Furthermore, the fillet, which has the radius RC of curvature, is formed by the brazing material, which covers the wall surface of the valley of the inner fin 31. Normally, the fillets are formed to maintain an equilibrium state, in which the radiuses RA, RB, RC of curvature are generally equal to each other. The sub-passage 321 of FIG. 4 is not in the state where the sub-passage 321 is clogged with the brazing material. Specifically, the sub-passage 321 of FIG. 4 is in a state where the clogging of the sub-passage 321 has not yet occurred.

Figure 5:
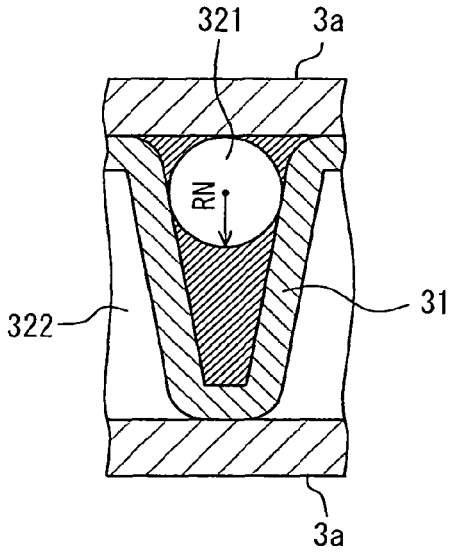
FIG. 5 is a cross-sectional view showing a sub-passage of the tube, which is immediately before occurrence of clogging with the brazing material upon increasing of the amount of the brazing material in comparison to that of FIG. 4.

When the amount of the brazing material is further increased in comparison to that of FIG. 4, the size of each fillet is further increased, as shown in FIG. 5. Thus, the cross section of the sub-passage 321 is surrounded by the fillets and becomes small. At this time, a radius RN of the cross section of the sub-passage 321 becomes generally equal to the radiuses RA, RB, RC of curvature. The state shown in FIG. 5 is a limit state with a limit size of the cross section of the sub-passage 321, below which the sub-passage 321 cannot be formed. When the amount of the brazing material is further increased from the state of FIG. 5, the sub-passage 321, which has the radius RN, is instantaneously filled with the brazing material, thereby resulting in the clogged state of the sub-passage 321. Specifically, when any one of the radiuses RA, RB, RC of curvature is further increased from the state of FIG. 5, the sub-passage 321 is instantaneously filled with the brazing material, thereby resulting in the clogging of the sub-passage 321.

Figure 6:
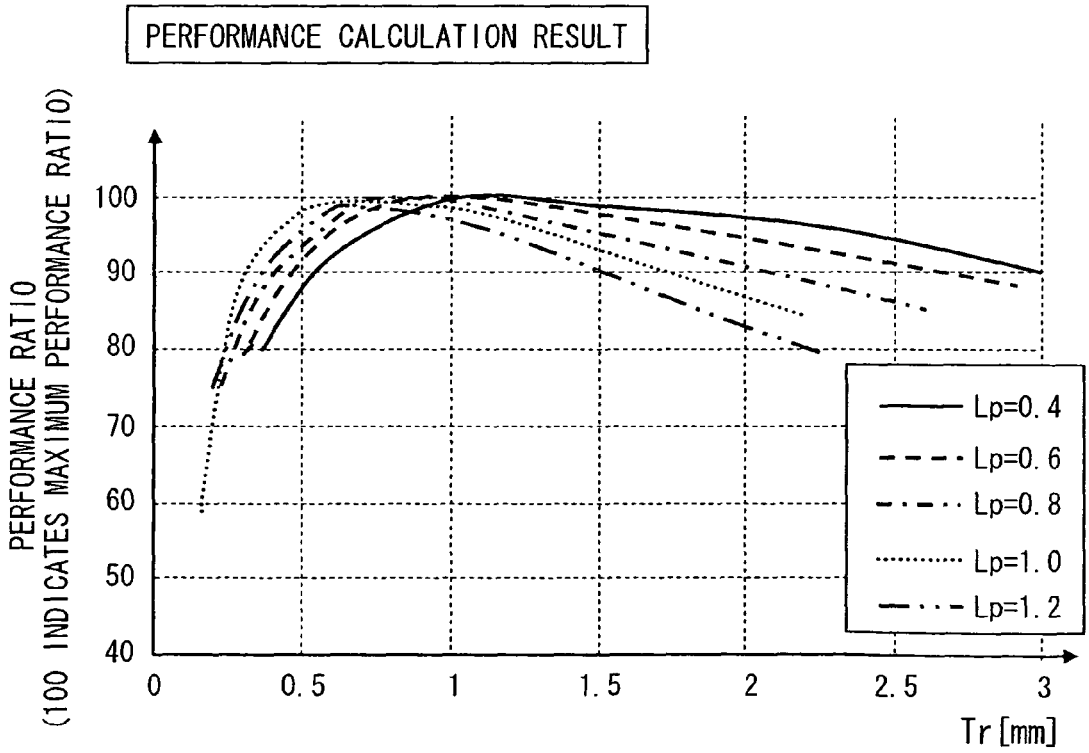
FIG. 6 is a diagram showing a result of analysis, indicating a relationship between a heat radiation performance ratio and Tr in a case where Lp is changed.
Figure 7:
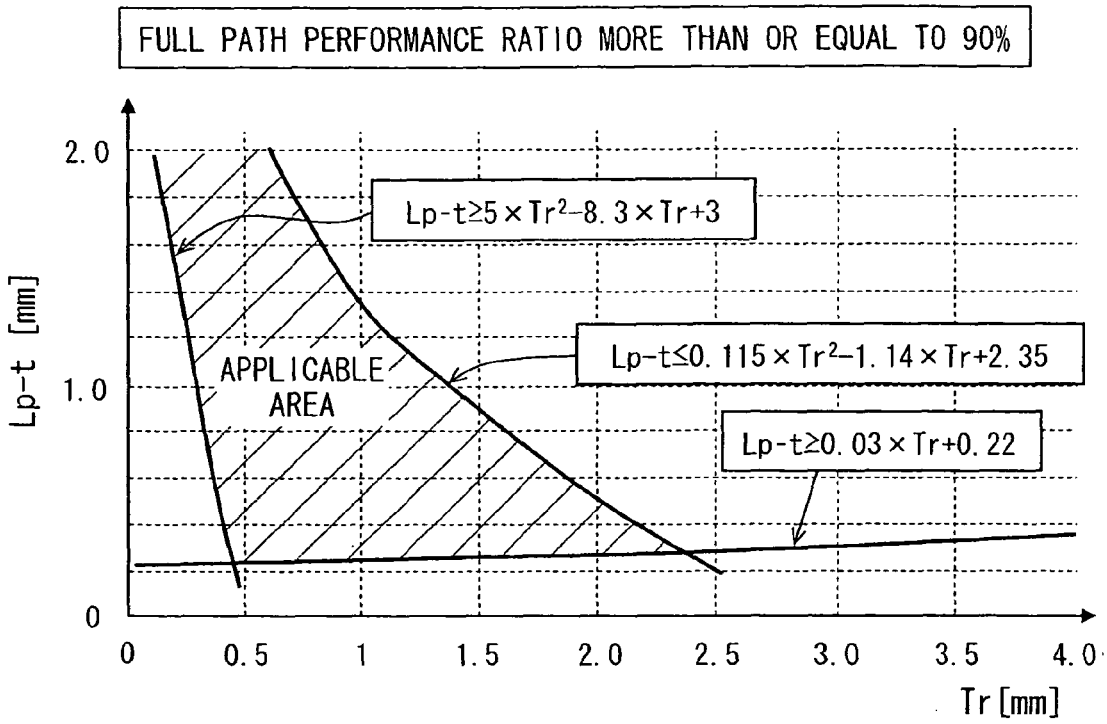
FIG. 7 is a graph showing an appropriate condition that is determined based on a corresponding performance evaluation result, which shows achievement of a heat radiation performance ratio of 90% or higher, and also based on verification of occurrence of the clogging with the brazing material in a case of the condenser of the first embodiment.
Figure 8:
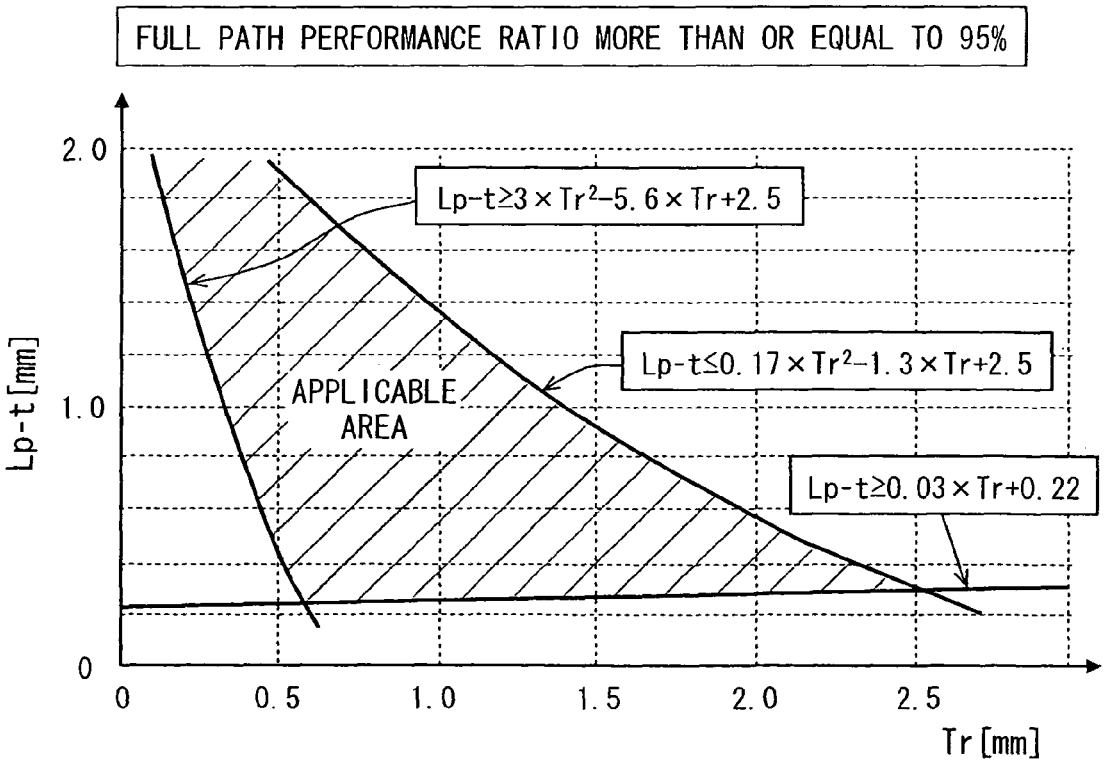
FIG. 8 is a graph showing an appropriate condition that is determined based on the corresponding performance evaluation result, which shows achievement of a heat radiation performance ratio of 95% or higher, and also based on the verification of occurrence of the clogging with the brazing material in the case of the condenser of the first embodiment.
Figure 9:
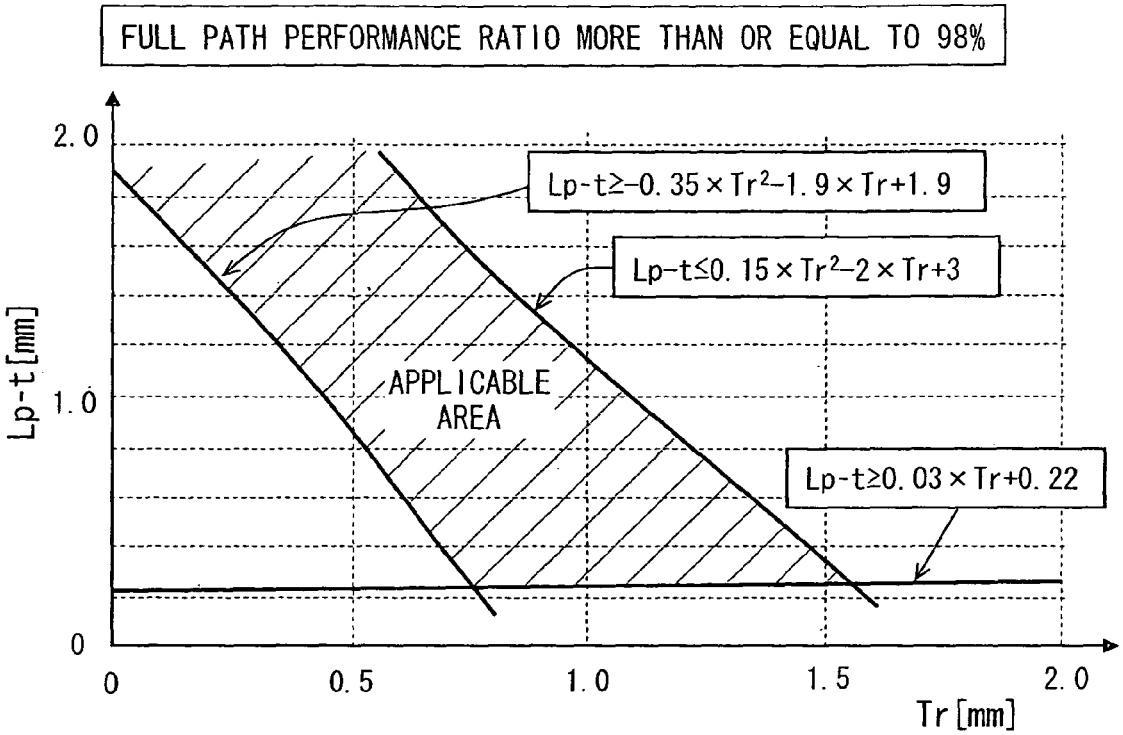
FIG. 9 is a graph showing an appropriate condition that is determined based on the corresponding performance evaluation result, which shows achievement of a heat radiation performance ratio of 98% or higher, and also based on the verification of occurrence of the clogging with the brazing material in the case of the condenser of the first embodiment.

FIG. 6 shows a result of analysis (simulation) illustrating a relationship between a heat radiation performance ratio and a refrigerant passage height Tr in a case where the width Lp of the sub-passage 321-324 is changed among various values discussed below. FIGS. 7 to 9 show appropriate heat radiation performance lines indicated by solid lines, which border on a corresponding shaded area located inside thereof in FIGS. 7 to 9. A result of the simulation of the heat radiation performance, which is conducted on the condenser 1, will now be described.

In this simulation, the various parameters are set as follows. Specifically, a height (core height) of the core 2 is in a range of 300 mm to 360 mm, and a width (core width) of the core 2 is in a range of 560 mm to 640 mm. A thickness (thickness of the condensing section 2*a*) D of the core 2 measured in the flow direction of the air at the core 2 is in a range of 12 mm to 16 mm. A plate thickness (wall thickness) of the tube 3 is in a range of 0.1 mm to 0.3 mm. A flow speed of the air at an inlet side of the condenser 1 is 2 m/s. A temperature of the air at the inlet of the condenser 1 is 35 degrees Celsius. A refrigerant pressure at the inlet of the condenser 1 is 1.744 MPa. A degree of superheating at the inlet of the condenser 1 is 1 degree Celsius. A degree of subcooling at the outlet of the condenser 1 is 20 degrees Celsius. With the above settings, the width Lp of the sub-passage 321-324 is varied among Lp=0.4 mm (see a solid line in FIG. 6), Lp=0.6 mm (see a dashed line in FIG. 6), Lp=0.8 mm (see a dot-dash line in FIG. 6), Lp=1.0 mm (see dotted line in FIG. 6) and Lp=1.2 mm (see a dot-dot-dash line in FIG. 6), and a ratio (hereinafter referred to as a heat radiation performance ratio) of the heat radiation performance relative to the refrigerant passage height Tr of the tube 3 is computed for these various values of the width Lp of the sub-passage 321-324. In FIG. 6, the heat radiation performance ratio along an axis of ordinates is indicated as a percentile value, and the maximum heat radiation performance of the condenser is set as 100%. The result of the simulation indicates that the heat radiation performance decreases after the peak of 100% for each of the various values of the width Lp of the sub-passage 321-324 discussed above.

The inventors of the present application have found a relationship between the refrigerant passage height Tr (mm) and Lp−t (mm) based on the result of the simulation shown in FIG. 6. This relationship between Tr (mm) and Lp−t (mm) is indicated by the solid lines, which border on the shaded area located inside thereof, in FIGS. 7 to 9. First of all, FIG. 7 is a graph indicating an appropriate condition (suitable condition) that is determined based on the corresponding performance evaluation result, which shows the achievement of the heat radiation performance ratio of 90% or higher, and also based on the verification of the occurrence of the clogging with the brazing material.

The inventors of the present application have performed the simulation to determine whether the clogging with the brazing material is present or absent based on the definition of the clogging with the brazing material discussed with reference to FIGS. 3 to 5. Then, based on this simulation, the inventors of the present application have determined whether the clogging with the brazing material is present for the various conditions, in which the combination of the refrigerant passage height Tr (mm) and the Lp−t (mm) is varied. Then, the inventors of the present application have found the relationship between the refrigerant passage height Tr (mm) and Lp−t (mm) for an area, in which the clogging with the brazing material is absent for all of the above conditions. This relationship is commonly indicated by the bottom side solid line in FIGS. 7 to 9.

This bottom side solid line is expressed by an equation of Lp−t=0.03Tr+0.22. Specifically, the clogging with the brazing material is absent in the area above this bottom side solid line and is present in the area below the bottom side solid line.

Therefore, with respect to the condensing section 2*a* of the condenser 1, the area, which satisfies the following equation 2, forms the appropriate condition, which should be satisfied to avoid the clogging with the brazing material.

$$Lp-t \geq 0.03Tr+0.22 \quad \text{(Equation 2)}$$

An equation 3 and an equation 4 indicated below define the area, in which the heat radiation performance ratio of 90% or higher can be achieved according to the result of analysis of FIG. 6 performed for the various values of the width Lp discussed above.

$$Lp-t \geq 5Tr^2-8.3Tr+3 \quad \text{(Equation 3)}$$

$$Lp-t \leq 0.115Tr^2-1.14Tr+2.35 \quad \text{(Equation 4)}$$

The shaded area of FIG. 7, which implements the appropriate condition that satisfies all of the equation 2, the equation 3 and the equation 4, is an applicable area (usable area), in which the heat radiation performance ratio of 90% or higher can be achieved in the condenser 1 having the condensing section 2*a* of the full-path flow type. In order to limit the clogging with the brazing material and to achieve the sufficient performance, it is preferred to form the tubes 3 of the condenser 1 by setting the values of Lp, Tr and Lp−t in a manner that satisfies the appropriate condition discussed above.

Now, there will be described an appropriate condition, which should be satisfied to manufacture the condenser 1 that can achieve the improved heat radiation performance ratio of 95% or higher. FIG. 8 is a graph indicating the appropriate condition that is determined based on the corresponding performance evaluation result, which shows the achievement of the heat radiation performance ratio of 95% or higher, and also based on the verification of the occurrence of the clogging with the brazing material.

An equation 5 and an equation 6 indicated below define the area, in which the heat radiation performance ratio of 95% or higher can be achieved according to the result of the analysis of FIG. 6 for the various values of the width Lp discussed above.

$$Lp-t \geq 3Tr^2-5.6Tr+2.5 \quad \text{(Equation 5)}$$

$$Lp-t \leq 0.17Tr^2-1.3Tr+2.5 \quad \text{(Equation 6)}$$

The shaded area of FIG. 8, which implements the appropriate condition that satisfies all of the equation 5, the equation 6 and the equation 2, is an applicable area (usable area), in which the heat radiation performance ratio of 95% or higher can be achieved in the condenser 1 having the condensing section 2*a* of the full-path flow type. In order to limit the clogging with the brazing material and to achieve the sufficient performance, it is preferred to form the tubes 3 of the condenser 1 by setting the values of Lp, Tr and Lp−t in a manner that satisfies the appropriate condition discussed above.

Now, there will be described an appropriate condition, which should be satisfied to manufacture the condenser 1 that can achieve the improved heat radiation performance ratio of. 98% or higher. FIG. 9 is a graph indicating the appropriate condition that is determined based on the corresponding performance evaluation result, which shows the achievement of the heat radiation performance ratio of 98% or higher, and also based on the verification of the occurrence of the clogging with the brazing material.

An equation 7 and an equation 8 indicated below define an area, in which the heat radiation performance ratio of 98% or higher can be achieved according to the result of analysis of FIG. 6 for the various values of the width Lp discussed above.

$$Lp-t \geq -0.35Tr^2-1.9Tr+1.9 \quad \text{(Equation 7)}$$

$$Lp-t \leq 0.15Tr^2-2Tr+3 \quad \text{(Equation 8)}$$

The shaded area of FIG. 9, which implements the appropriate condition that satisfies all of the equation 7, the equation 8 and the equation 2, is an applicable area (usable area), in which the heat radiation performance ratio of 98% or higher can be achieved in the condenser 1 having the condensing section 2*a* of the full-path flow type. In order to limit the clogging with the brazing material and to achieve the sufficient performance, it is further preferred to form the tubes 3 of the condenser 1 by setting the values of Lp, Tr and Lp−t in a manner that satisfies the appropriate condition discussed above.

As discussed above, the condenser 1 of the present embodiment has the tubes 3, which are stacked one after another. The refrigerant passage 32, which conducts the refrigerant therethrough, is formed in the inside of each tube 3. Furthermore, the inner fin 31 is placed in the inside of the tube 3 to divide the refrigerant passage 32 into the sub-passages 321-324. Further, in the condenser 1, at least one of the surface of the inner fin 31 and each inner wall surface 3*a*1 of the tube 3 is covered with the brazing material. Furthermore, as discussed above, the tubes 3 of the condenser 1 are manufactured to satisfy the equation 2, the equation 3 and the equation 4. In these equations, Lp denotes the width of one of sub-passages 321-324 defined by the inner fin 31. Tr denotes the refrigerant passage height, which is the height of the refrigerant passage 32 and is measured in the stacking direction of the tubes 3, and t denotes the plate thickness (wall thickness) of the inner fin 31. The amount α(α=S/L (mm)) of the brazing material per unit length of the center line of the corresponding portion of the inner fin 31, which is present through the entire extent of the width Lp (mm) of the one of the sub-passages 321-324 in the plane that is parallel to the row direction of the sub-passages 321-324, is set to satisfy the relationship of $0.005 \leq \alpha < 0.5$.

Thereby, with the above-described structure, the amount α(α=S/L (mm)) of the brazing material per unit length of the center line of the corresponding portion of the inner fin 31 is set to satisfy the relationship of $0.005 \leq \alpha < 0.5$. The width Lp of the sub-passage 321-324, the refrigerant passage height Tr and the plate thickness (wall thickness) t of the inner fin 31 are set to satisfy the equation 2, the equation 3 and the equation 4. In this way, it is possible to limit the clogging at the inside of the tube 3 with the brazing material and to limit the loss of the internal pressure of the tube 3 while achieving the sufficient heat radiation performance of the condenser 1. Therefore, it is possible to manufacture the condenser 1, which can implement both of the limiting of the clogging of the inside of the tube 3 and the achieving of the sufficient performance.

(Second Embodiment)

Figure 10:
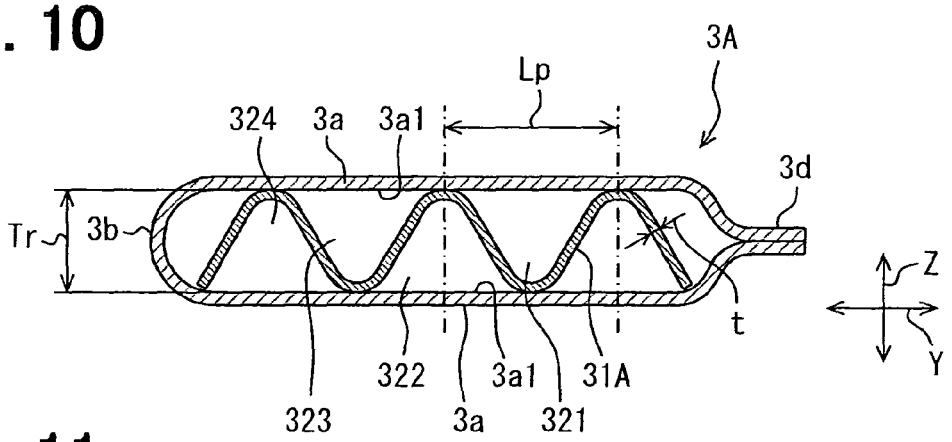
FIG. 10 is a cross-sectional view showing a structure in an inside of a tube according to a second embodiment of the present invention.

A second embodiment of the present invention will be described with reference to FIG. 10. The second embodiment is similar to the first embodiment except tubes 3A, which are provided in place of the tubes 3 of the first embodiment. FIG. 10 is a cross-sectional view showing the structure in the inside of the tube 3A of the second embodiment. In FIG. 10, components, which are similar to those of FIG. 2, will be indicated by the same reference numerals and have the function (and the advantage) similar to that of FIG. 2.

The structure of the tube 3A of the second embodiment is different from that of the tube 3 of the first embodiment with respect to the following point. That is, an end part of an inner fin 31A is not clamped by the connecting portion 3*d*. Specifically, the surfaces of the ridges and the valleys of the inner fin 31A are securely joined to the inner wall surfaces 3*a*1 of the opposed planar portions 3*a* of the tube 3A by the brazing. In the second embodiment, the rest of the structure, which is other than the above difference, is the same as that of the first embodiment and can achieve the similar advantages, which are similar to those discussed in the first embodiment. Furthermore, the width Lp of the sub-passage 321-324, the refrigerant passage height Tr and the plate thickness (wall thickness) t of the inner fin 31A are set as indicated in FIG. 10.

(Third Embodiment)

Figure 11:
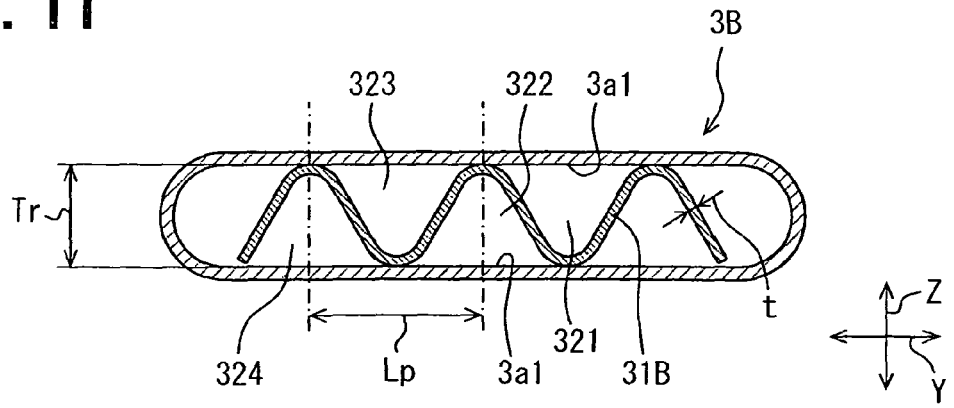
FIG. 11 is a cross-sectional view showing a structure in an inside of a tube according to a third embodiment of the present invention.

A third embodiment of the present invention will be described with reference to FIG. 11. The third embodiment is similar to the second embodiment except tubes 3B, which are provided in place of the tubes 3A of the second embodiment. FIG. 11 is a cross-sectional view showing the structure in the inside of the tube 3B of the third embodiment. In FIG. 11, components, which are similar to those of FIGS. 2 and 10, will be indicated by the same reference numerals and have the function (and the advantage) similar to that of FIGS. 2 and 10.

The structure of the tube 3B of the third embodiment is similar to that of the tube 3A of the second embodiment with respect to the joining of the surfaces of the ridges and the valleys of the inner fin 31B to the inner wall surfaces 3*a*1 of the opposed planar portions 3*a* of the tube 3A by the brazing. However, the structure of the tube 3B of the third embodiment is different from that of the tube 3A of the second embodiment with respect a way of forming the tube 3B. Unlike the tube 3A of the second embodiment, in which the one end parts of the planar portions 3*a* that are bent generally 180 degrees relative to each other are placed parallel to each other and are joined together, the tube 3B of the third embodiment is formed through an extruding process, in which a metal material is extruded through application of a pressure, thereby resulting in a seamless tube. Specifically, the tube 3B is formed to have a tube body upon the completion of the extruding process. Furthermore, the width Lp of the sub-passage 321-324, the refrigerant passage height Tr and the plate thickness (wall thickness) t of the inner fin 31B are set as indicated in FIG. 11.

(Fourth Embodiment)

Figure 12:
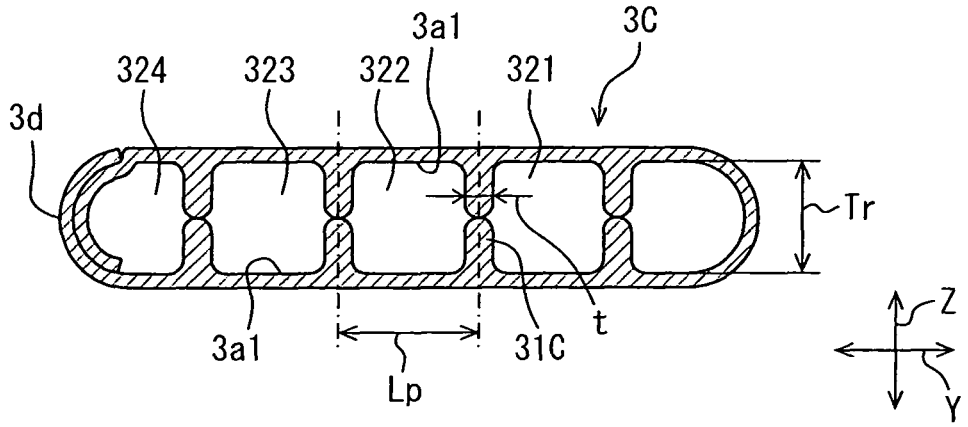
FIG. 12 is a cross-sectional view showing a structure in an inside of a tube according to a fourth embodiment of the present invention.

A fourth embodiment of the present invention will be described with reference to FIG. 12. The fourth embodiment is similar to the first embodiment except tubes 3C, which are provided in place of the tubes 3 of the first embodiment. FIG. 12 is a cross-sectional view showing the structure in the inside of the tube 3C of the fourth embodiment. In FIG. 12, components, which are similar to those of FIG. 2, will be indicated by the same reference numerals and have the function (and the advantage) similar to that of FIG. 2.

The structure of the tube 3C of the fourth embodiment is similar to that of the tube 3 of the first embodiment with respect to joining of the bent end parts of the planar portions 3*a* of the tube 3C, which are bent generally 180 degrees relative to each other, to form the tube body. However, the structure of the tube 3C of the fourth embodiment is different from that of the tube 3 of the first embodiment with respect to the following point. That is, inner fins 31C are formed integrally with the tube 3C. Specifically, the way of forming the tube 3C is as follows. First of all, a metal plate is processed in a press working in such a manner that protrusions protrude from predetermined location of the metal plate. Then, this metal plate is bent 180 degrees. Thereafter, the bent end parts (connecting portion 3*d*) of the metal plate are joined together to form the tube body. At this time, each protrusion, which is preformed in the metal plate, contacts the opposed protrusion or the inner wall surface 3*a*1 of the tube 3C and thereby functions as the inner fin 31C in the inside of the tube 3C. In this way, the inner fins 31C can be formed integrally with the tube 3C. Furthermore, the width Lp of the sub-passage 321-324, the refrigerant passage height Tr and the plate thickness (wall thickness) t of the inner fin 31C are set as indicated in FIG. 12.

(Fifth Embodiment)

Figure 13:
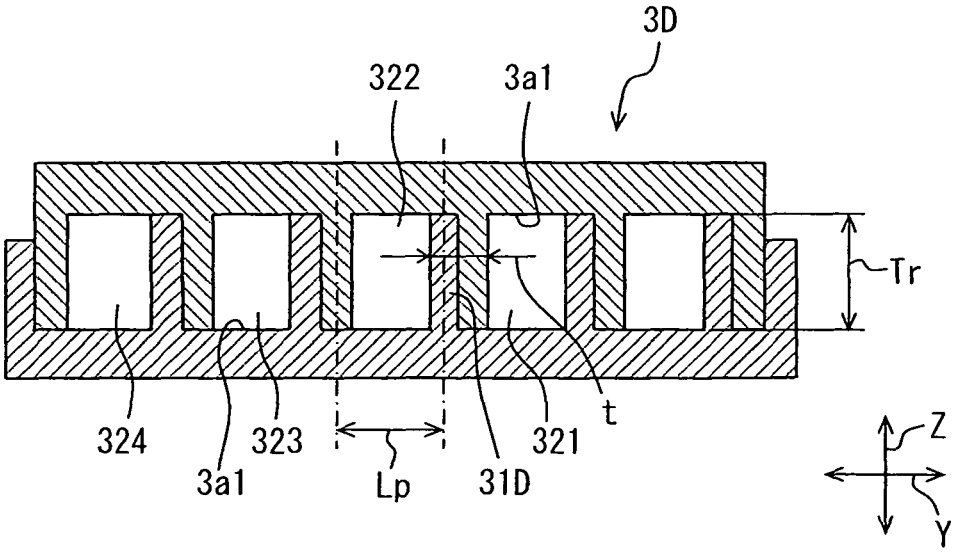
FIG. 13 is a cross-sectional view showing a structure in an inside of a tube according to a fifth embodiment of the present invention.

A fifth embodiment of the present invention will be described with reference to FIG. 13. The fifth embodiment is similar to the fourth embodiment except tubes 3D, which are provided in place of the tubes 3C of the fourth embodiment. FIG. 13 is a cross-sectional view showing the structure in the inside of the tube 3D of the fifth embodiment. In FIG. 13, components, which are similar to those of FIGS. 2 and 12, will be indicated by the same reference numerals and have the function (and the advantage) similar to that of FIGS. 2 and 12

The structure of the tube 3D of the fifth embodiment is similar to that of the tube 3C of the fourth embodiment with respect to the integral formation of the inner fins 31D with the tube 3D. However, the structure of the tube 3D of the fifth embodiment is different from that of the tube 3C of the fourth embodiment with respect a way of forming the tube 3D. That is, the tube 3D is formed by opposing and joining two separate members. Specifically, the way of forming the tube 3D is as follows. First of all, two metal plates are respectively processed to form protrusions, which protrude from predetermined locations of the corresponding metal plate. Then, the metal plates having the protrusions are opposed to each other such that the protrusions of the metal plates cooperate together to form the sub-passages 321-324. Thereafter, these plates are joined together by the brazing to form the tubular body. At this time, each protrusion, which is preformed in each metal plate, contacts the opposed protrusion or the inner wall surface 3*a*1 of the tube 3D and thereby functions as the inner fin 31D in the inside of the tube 3D. In this way, the inner fins 31D can be formed integrally with the tube 3D.

Furthermore, the width Lp of the sub-passage 321-324, the refrigerant passage height Tr and the plate thickness (wall thickness) t of the inner fin 31D are set as indicated in FIG. 13. The plate thickness (wall thickness) t of the inner fin 31D is measured as a thickness of the partition wall part, which partitions between corresponding adjacent two of the sub-passages 321-324. Therefore, as shown in FIG. 13, in the case where the two inner fins 31D are placed adjacent to each other to function as the partition wall part, which partitions between the corresponding adjacent two of the sub-passages 321-324, a sum of the thicknesses of these two inner fins 31D serves as the plate thickness t. Alternatively, in a case where a single inner fin (one inner fin) 31D partitions between the corresponding adjacent two of the sub-passages 321-324, the thickness of the one inner fin 31D serves as the plate thickness t.

The preferred embodiments of the present invention have been described. However, the present invention is not limited to the above embodiments, and the above embodiments may be modified in various ways without departing from the spirit and scope of the invention.

For instance, the inner fin(s) of any one of the first to fifth embodiments may be placed in the inside of all of the tubes of the condenser. Alternatively, the inner fin(s) of any one of the first to fifth embodiments may be placed in the inside of only one or more of the tubes of the condenser. In such a case, the inner fin(s) may be placed in the inside of the tube(s) located in, for example, a predetermined location of the core.

A louver may be formed in the inner fin(s) of the first to fifth embodiments by cutting and bending a portion of the inner fin to change the flow of the refrigerant that flows along the inner fin.

What is claimed is:

1. A condenser comprising a condensing section that includes:

a plurality of tubes, which are stacked one after another in a stacking direction, wherein each of the plurality of tubes forms a refrigerant passage therein to conduct refrigerant and is adapted to exchange heat between the refrigerant, which is in gas phase and is conducted through the refrigerant passage, and external fluid, which flows outside of the tube, to cause condensation of the refrigerant in the gas phase into the refrigerant in liquid phase in the tube at the condensing section; and a plurality of fins, each of which is placed in an inside of a corresponding one of the plurality of tubes to divide the refrigerant passage of the tube into a plurality of sub-passages, which are arranged one after another in a row in a row direction, wherein:

at least a surface of each corresponding one of the plurality of fins placed in the tube is covered with a brazing material;

each of the plurality of tubes and each corresponding one of the plurality of fins satisfy all of the following relationships:

$$Lp-t \geq 0.03Tr+0.22;$$

$$Lp-t \leq 0.115Tr^2-1.14Tr+2.35; \text{ and}$$

$$Lp-t \geq 5Tr^2-8.3Tr+3, \text{ where:}$$

Lp denotes a width of one of the plurality of sub-passages of the tube;

Tr denotes a refrigerant passage height, which is a height of the refrigerant passage of the tube measured in the stacking direction of the plurality of tubes; and t denotes a plate thickness of the fin in the tube;

the brazing material, which covers at least the surface of each corresponding one of the plurality of fins placed in the tube, satisfies a relationship of $0.005 \leq S/L < 0.5$, where:

S denotes a size of a cross-sectional area of the brazing material, which is present through an entire extent of the width of the one of the plurality of sub-passages in a plane that is parallel to the row direction of the plurality of sub-passages;

L denotes a length of a center line of a corresponding portion of the fin, which is present through the entire extent of the width of the one of the plurality of sub-passages in the plane that is parallel to the row direction of the plurality of sub-passages; and S/L denotes an amount of the brazing material per unit length of the center line of the corresponding portion of the fin, which is present through the entire extent of the width of the one of the plurality of the sub-passages in the plane that is parallel to the row direction of the plurality of sub-passages; and an amount of the brazing material, which is present in each of the plurality of sub-passages, is set to form:

a first fillet that is formed in a valley of the corresponding fin in the sub-passage, wherein a cross section of the first fillet has a first concave meniscus having a first radius of curvature;

a second fillet that is formed between an inner wall surface of the corresponding tube and one of two ridges of the corresponding fin in the sub-passage, wherein a cross section of the second fillet has a second concave meniscus continuously extending between the inner wall surface of the corresponding tube and the one of the two ridges of the corresponding fin, and wherein the second concave meniscus has a second radius of curvature, and wherein one end of the second fillet facing the first fillet is discontinuous from one end of the first fillet; and a third fillet that is formed between the inner wall surface of the corresponding tube and another one of the two ridges of the corresponding fin in the sub-passage, wherein a cross section of the third fillet has a third concave meniscus continuously extending between the inner wall surface of the corresponding tube and the another one of the two ridges of the corresponding fin, and wherein the third concave meniscus has a third radius of curvature, and wherein one end of the third fillet facing the first fillet is discontinuous from another end of the first fillet, and wherein another end of the third fillet facing the second fillet is discontinuous from another end of the second fillet.

2. The condenser according to claim 1, wherein the width Lp of the one of the plurality of sub-passages, the refrigerant passage height Tr, and the plate thickness t of the fin satisfy all of the following relationships:

$$Lp-t \geq 0.03Tr+0.22;$$

$$Lp-t \leq 0.17Tr^2-1.3Tr+2.5; \text{ and}$$

$$Lp-t \geq 3Tr^2-5.6Tr+2.5.$$

3. The condenser according to claim 1, wherein the width Lp of the one of the plurality of sub-passages, the refrigerant passage height Tr, and the plate thickness t of the fin satisfy all of the following relationships:

$$Lp-t \geq 0.03Tr+0.22;$$

$$Lp-t \leq 0.15Tr^2-2Tr+3; \text{ and}$$

$$Lp-t \geq -0.35Tr^2-1.9Tr+1.9.$$

4. The condenser according to claim 1, wherein the inner wall surface of each of the plurality of tubes is covered with the brazing material.

5. The condenser according to claim 1, wherein the first concave meniscus continuously extends between two connecting portions, each of which connects between the valley of the corresponding fin and a corresponding one of the two ridges of the corresponding fin in the sub-passage.

6. A condenser comprising a condensing section that includes:

a plurality of tubes, which are stacked one after another in a stacking direction, wherein each of the plurality of tubes forms a refrigerant passage therein to conduct refrigerant and is adapted to exchange heat between the refrigerant, which is in gas phase and is conducted through the refrigerant passage, and external fluid, which flows outside of the tube, to cause condensation of the refrigerant in the gas phase into the refrigerant in liquid phase in the tube at the condensing section; and a plurality of fins, each of which is placed in an inside of a corresponding one of the plurality of tubes to divide the refrigerant passage of the tube into a plurality of sub-passages, which are arranged one after another in a row in a row direction, wherein:

at least a surface of each corresponding one of the plurality of fins placed in the tube is covered with a brazing material;

each of the plurality of tubes and each corresponding one of the plurality of fins satisfy all of the following relationships:

$$Lp-t \geq 0.03Tr+0.22;$$

$$Lp-t \leq 0.115Tr^2-1.14Tr+2.35; \text{ and}$$

$$Lp-t \geq 5Tr^2-8.3Tr+3, \text{ where:}$$

Lp denotes a width of one of the plurality of sub-passages of the tube;

Tr denotes a refrigerant passage height, which is a height of the refrigerant passage of the tube measured in the stacking direction of the plurality of tubes; and t denotes a plate thickness of the fin in the tube;

the brazing material, which covers at least the surface of each corresponding one of the plurality of fins placed in the tube, satisfies a relationship of $0.005 \leq S/L < 0.5$, where:

S denotes a size of a cross-sectional area of the brazing material, which is present through an entire extent of the width of the one of the plurality of sub-passages in a plane that is parallel to the row direction of the plurality of sub-passages;

L denotes a length of a center line of a corresponding portion of the fin, which is present through the entire extent of the width of the one of the plurality of sub-passages in the plane that is parallel to the row direction of the plurality of sub-passages; and S/L denotes an amount of the brazing material per unit length of the center line of the corresponding portion of the fin, which is present through the entire extent of the width of the one of the plurality of the sub-passages in the plane that is parallel to the row direction of the plurality of sub-passages; and an amount of the brazing material, which is present in each of the plurality of sub-passages, is smaller than a threshold amount of the brazing material present in each of the plurality of sub-passages in a state where the brazing material in each of the plurality of sub-passages forms:

a single first-side fillet, which is formed in a valley of the corresponding fin in the sub-passage, wherein a cross section of the first-side fillet has a first concave meniscus continuously extending between two connecting portions, each of which connects between the valley of the corresponding fin and a corresponding one of two ridges of the corresponding fin in the sub-passage, and wherein the first concave meniscus has a first radius of curvature, which is equal to a radius of an inscribed circle that inscribes the sub-passage; and two second-side fillets, wherein each of the two second-side fillets is formed between an inner wall surface of the corresponding tube and a corresponding one of the two ridges of the corresponding fin, and wherein a cross section of each of the two second-side fillets has a second concave meniscus continuously extending between the inner wall surface of the corresponding tube and the corresponding one of the two ridges of the corresponding fin, and the second concave meniscus has a second radius of curvature which is equal to the radius of the inscribed circle.

7. A condenser comprising a condensing section that includes:

a plurality of tubes, which are stacked one after another in a stacking direction, wherein each of the plurality of tubes forms a refrigerant passage therein to conduct refrigerant and is adapted to exchange heat between the refrigerant, which is in gas phase and is conducted through the refrigerant passage, and external fluid, which flows outside of the tube, to cause condensation of the refrigerant in the gas phase into the refrigerant in liquid phase in the tube at the condensing section; and a plurality of fins, each of which is placed in an inside of a corresponding one of the plurality of tubes to divide the refrigerant passage of the tube into a plurality of sub-passages, which are arranged one after another in a row in a row direction, wherein:

at least a surface of each corresponding one of the plurality of fins placed in the tube is covered with a brazing material;

each of the plurality of tubes and each corresponding one of the plurality of fins satisfy all of the following relationships:

$$Lp-t \geq 0.03Tr+0.22;$$

$$Lp-t \leq 0.115Tr^2-1.14Tr+2.35; \text{ and}$$

$$Lp-t \geq 5Tr^2-8.3Tr+3, \text{ where:}$$

Lp denotes a width of one of the plurality of sub-passages of the tube;

Tr denotes a refrigerant passage height, which is a height of the refrigerant passage of the tube measured in the stacking direction of the plurality of tubes; and t denotes a plate thickness of the fin in the tube;

the brazing material, which covers at least the surface of each corresponding one of the plurality of fins placed in the tube, satisfies a relationship of $0.005 \leq S/L < 0.5$, where:

S denotes a size of a cross-sectional area of the brazing material, which is present through an entire extent of the width of the one of the plurality of sub-passages in a plane that is parallel to the row direction of the plurality of sub-passages;

L denotes a length of a center line of a corresponding portion of the fin, which is present through the entire extent of the width of the one of the plurality of sub-passages in the plane that is parallel to the row direction of the plurality of sub-passages; and S/L denotes an amount of the brazing material per unit length of the center line of the corresponding portion of the fin, which is present through the entire extent of the width of the one of the plurality of the sub-passages in the plane that is parallel to the row direction of the plurality of sub-passages; and an amount of the brazing material, which is present in each of the plurality of sub-passages, is smaller than a threshold amount of the brazing material present in each of the plurality of sub-passages in a state where the brazing material in each of the plurality of sub-passages forms:

a first fillet that is formed in a valley of the corresponding fin in the sub-passage, wherein a cross section of the first fillet has a first concave meniscus having a first radius of curvature;

a second fillet that is formed between an inner wall surface of the corresponding tube and one of two ridges of the corresponding fin in the sub-passage, wherein a cross section of the second fillet has a second concave meniscus continuously extending between the inner wall surface of the corresponding tube and the one of the two ridges of the corresponding fin, and wherein the second concave meniscus has a second radius of curvature, and wherein one end of the second fillet facing the first fillet is continuous from one end of the first fillet; and a third fillet that is formed between the inner wall surface of the corresponding tube and another one of the two ridges of the corresponding fin in the sub-passage, wherein a cross section of the third fillet has a third concave meniscus continuously extending between the inner wall surface of the corresponding tube and the another one of the two ridges of the corresponding fin, and wherein the third concave meniscus has a third radius of curvature, and wherein one end of the third fillet facing the first fillet is continuous from another end of the first fillet, and wherein another end of the third fillet facing the second fillet is continuous from another end of the second fillet.

8. The condenser according to claim 7, wherein the first concave meniscus continuously extends between two connecting portions, each of which connects between the valley of the corresponding fin and a corresponding one of the two ridges of the corresponding fin in the sub-passage.

* * * * *